US007013510B1

(12) United States Patent
Johnson

(10) Patent No.: US 7,013,510 B1
(45) Date of Patent: Mar. 21, 2006

(54) LOW PROFILE HOSPITAL BED

(75) Inventor: Michael Karl Johnson, Hays, KS (US)

(73) Assignee: Raye's, Inc., Ellis, KS (US)

( * ) Notice: Subject to any disclaimer, the term of this patent is extended or adjusted under 35 U.S.C. 154(b) by 58 days.

(21) Appl. No.: 10/823,907

(22) Filed: Apr. 14, 2004

(51) Int. Cl.
*A61G 7/012* (2006.01)
*A61G 1/02* (2006.01)

(52) U.S. Cl. ..... 5/611; 5/86.1; 296/20

(58) Field of Classification Search ..... 5/611, 5/600, 11, 86.1, 83.1, 81.1 R; 296/20
See application file for complete search history.

(56) References Cited

U.S. PATENT DOCUMENTS 2,564,333 A * 8/1951 Kelly ..... 296/20
2,841,438 A * 7/1958 Weil ..... 296/20
2,877,047 A * 3/1959 Weil ..... 296/20
2,877,048 A * 3/1959 Weil ..... 296/20
2,889,561 A * 6/1959 Martin ..... 5/110
3,003,159 A * 10/1961 Hebert et al. ..... 5/611
3,057,655 A * 10/1962 Weil et al. ..... 296/20
3,088,770 A * 5/1963 Weil et al. ..... 296/20
3,305,876 A * 2/1967 Hutt ..... 5/11
3,493,262 A * 2/1970 Ferneau ..... 296/20
3,802,002 A * 4/1974 Jonas ..... 5/611
3,826,528 A * 7/1974 East ..... 296/20
4,023,849 A * 5/1977 Bethlen ..... 296/20
4,192,541 A * 3/1980 Ferneau ..... 296/20
4,682,810 A * 7/1987 Zarka ..... 296/20
4,921,295 A * 5/1990 Stollenwerk ..... 296/20
5,015,024 A * 5/1991 Bloemer ..... 296/20
5,084,922 A * 2/1992 Louit ..... 296/20
5,432,966 A * 7/1995 Berta et al. ..... 5/611
5,509,159 A * 4/1996 Du-Bois ..... 5/627
6,405,393 B1 * 6/2002 Megown ..... 5/611
6,473,922 B1 * 11/2002 Sommerfeld et al. ..... 5/610
6,578,216 B1 * 6/2003 Aarestad ..... 5/618
6,601,251 B1 * 8/2003 Paul ..... 5/611
6,735,794 B1 * 5/2004 Way et al. ..... 5/86.1

(Continued)

FOREIGN PATENT DOCUMENTS

DE 3631409 A1 * 3/1988

(Continued)

*Primary Examiner*—Robert G. Santos
(74) *Attorney, Agent, or Firm*—Spencer Fane Britt & Browne LLP

(57) ABSTRACT

A low profile hospital bed includes a mattress support frame and pivotably mounted wheel frames. Lift actuators connecting between the mattress support frame and the wheel frames move the wheel frames between a folded position and an unfolded position. When the wheel frames are in the folded position, the lift actuators are relatively horizontal and thus unable to provide enough vertical force to move the wheel frames. Accordingly, connecting between the actuators and the wheel frames are leverage members which rotate and urge the wheel frames away from mattress support frame during an initial, first stage of movement as the wheel frames partially unfold. After the first stage of movement, the leverage members function as simple mechanical links between the lift actuators and the wheel frames as the lift actuators continue to power the complete unfolding of the wheel frames.

14 Claims, 18 Drawing Sheets

U.S. PATENT DOCUMENTS

| | | | | |
|---|---|---|---|---|
| 6,880,202 | B1 * | 4/2005 | Thompson et al. | 16/35 R |
| 6,920,656 | B1 * | 7/2005 | Roussy | 5/611 |
| 6,941,600 | B1 * | 9/2005 | Freeborn et al. | 5/611 |
| 2001/0047546 | A1 * | 12/2001 | Megown | 5/611 |
| 2003/0172459 | A1 * | 9/2003 | Roussy | 5/611 |
| 2004/0088792 | A1 * | 5/2004 | O'Krangley et al. | 5/611 |
| 2004/0111798 | A1 * | 6/2004 | Matunaga et al. | 5/86.1 |
| 2004/0128766 | A1 * | 7/2004 | Freeborn et al. | 5/611 |
| 2005/0091747 | A1 * | 5/2005 | Freeborn et al. | 5/611 |

FOREIGN PATENT DOCUMENTS

| | | | |
|---|---|---|---|
| DE | 3719781 | C1 * | 1/1989 |
| DE | 3824118 | A1 * | 1/1990 |
| GB | 2068301 | A * | 8/1981 |

* cited by examiner

LOW PROFILE HOSPITAL BED

FIELD OF THE INVENTION

This invention relates to a low profile hospital bed.

BACKGROUND OF THE INVENTION

Some hospital patients have a tendency to roll out of a hospital bed. This presents a significant risk of injury. In the past, hospitals and other care facilities have used various types of restraints to secure such patients. However, patient restraints are no longer favored in the modern hospital environment. An alternate solution to this problem has been to employ a low profile bed thus locating the surface of a the bed as close to the floor as possible. Yet, such a low profile bed must also be able to raise to a higher position so that doctors and nurses may have access to the patient. The arrangement of a very low profile bed typically places the actuators for raising and lowering the bed at a relatively shallow angle when the bed is in the lowered position. The actuator vertical force component available at such relatively shallow angles can become too small to lift the bed and the patient. This has limited the minimum height of mechanically actuated low profile hospital bed frames. What is needed is an arrangement which solves this problem and permits the design of a low profile hospital bed having a minimum height which is constrained not by actuator mechanics but by such considerations the required thickness of frame members and wheel clearance.

BRIEF DESCRIPTION OF THE INVENTION

In an embodiment of the present invention the aforementioned problem is addressed by providing a low profile hospital bed including a mattress support frame and wheel frames pivotably mounted to the mattress support frame which pivot between a folded position in which the mattress support frame is relatively close to the floor and a fully unfolded position in which the mattress support frame is at a maximum height above the floor. A leverage member for prying the wheel frame away from the mattress support frame is pivotably mounted to each wheel frame. Each leverage member is pivotably mounted to a wheel frame. A lift actuator connects between each leverage member and the mattress support frame. The leverage member is arranged to rotate relative to the wheel frame and push against the mattress support frame and thus pry the wheel frame away from the mattress support frame as the lift actuator begins extending from the its retracted position. The leverage member is also arranged to stop rotating relative to the wheel frame and thus stop pushing against the mattress support frame after the wheel frame has reached a partially unfolded position. After the leverage member has stopped rotating, it provides a simple mechanical link between the lift actuator and the wheel frame. Since the wheel frame is partially unfolded, the lift actuator has tilted sufficiently from its initial generally horizontal position to provide a sufficient amount of vertical force for powering the further unfolding of the wheel frame. As the lift actuator continues extending, the wheel frame unfolds to a fully unfolded position. Accordingly, in this embodiment of the present invention, a low profile bed is provided which can be folded into a flat configuration for providing a very low mattress elevation and yet which can be raised by lift actuators to provide a fully elevated bed.

DETAILED DESCRIPTION

Figure 1:
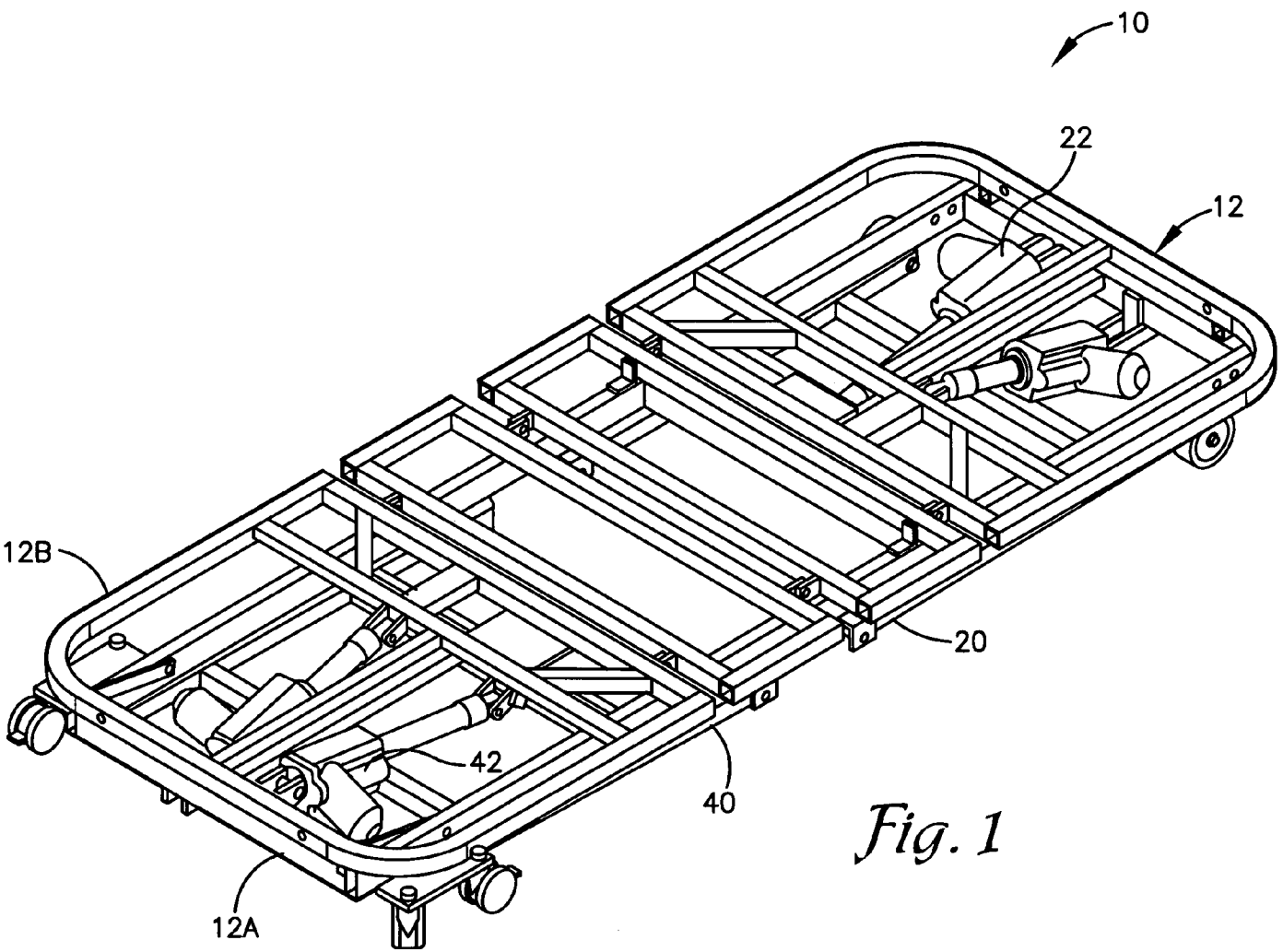
FIG. 1 is a top perspective view of the low profile hospital bed in the folded position.
Figure 2:
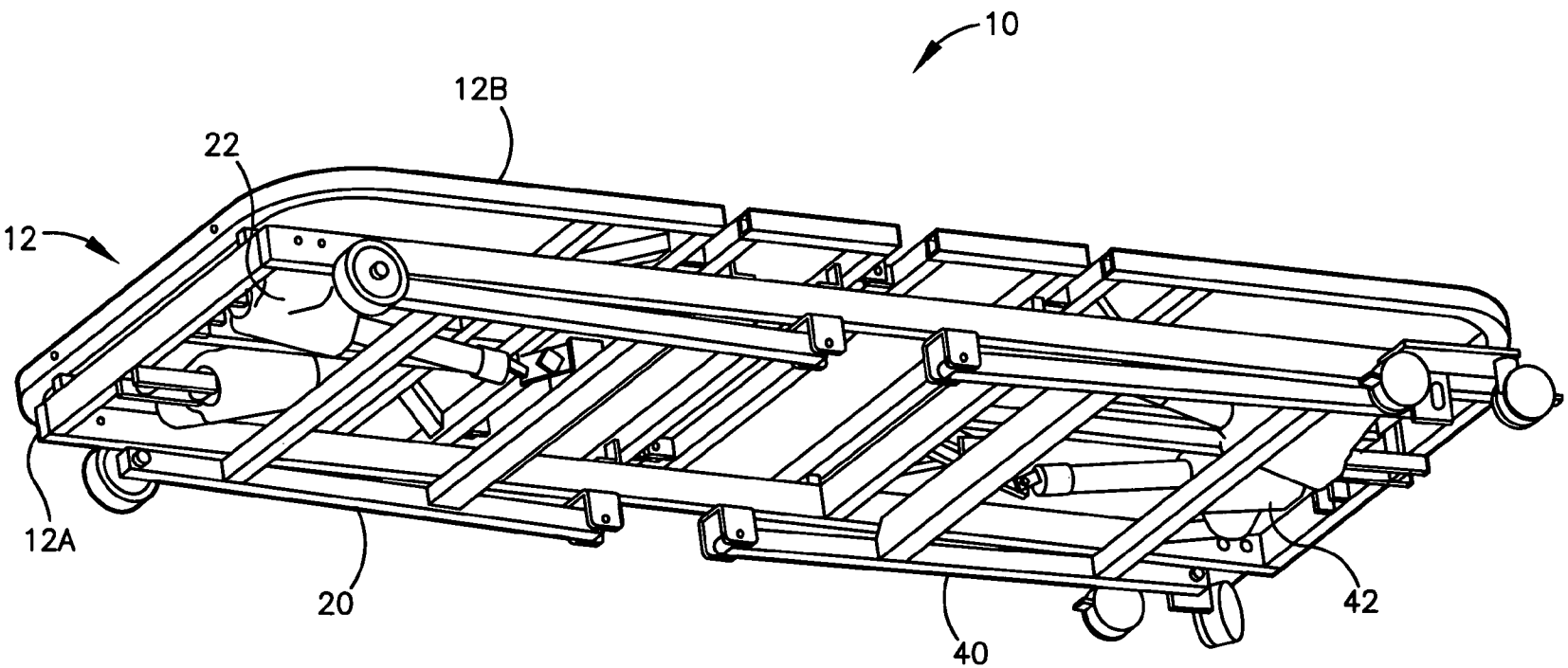
FIG. 2 is a bottom perspective view of the low profile hospital bed in the folded position.
Figure 3:
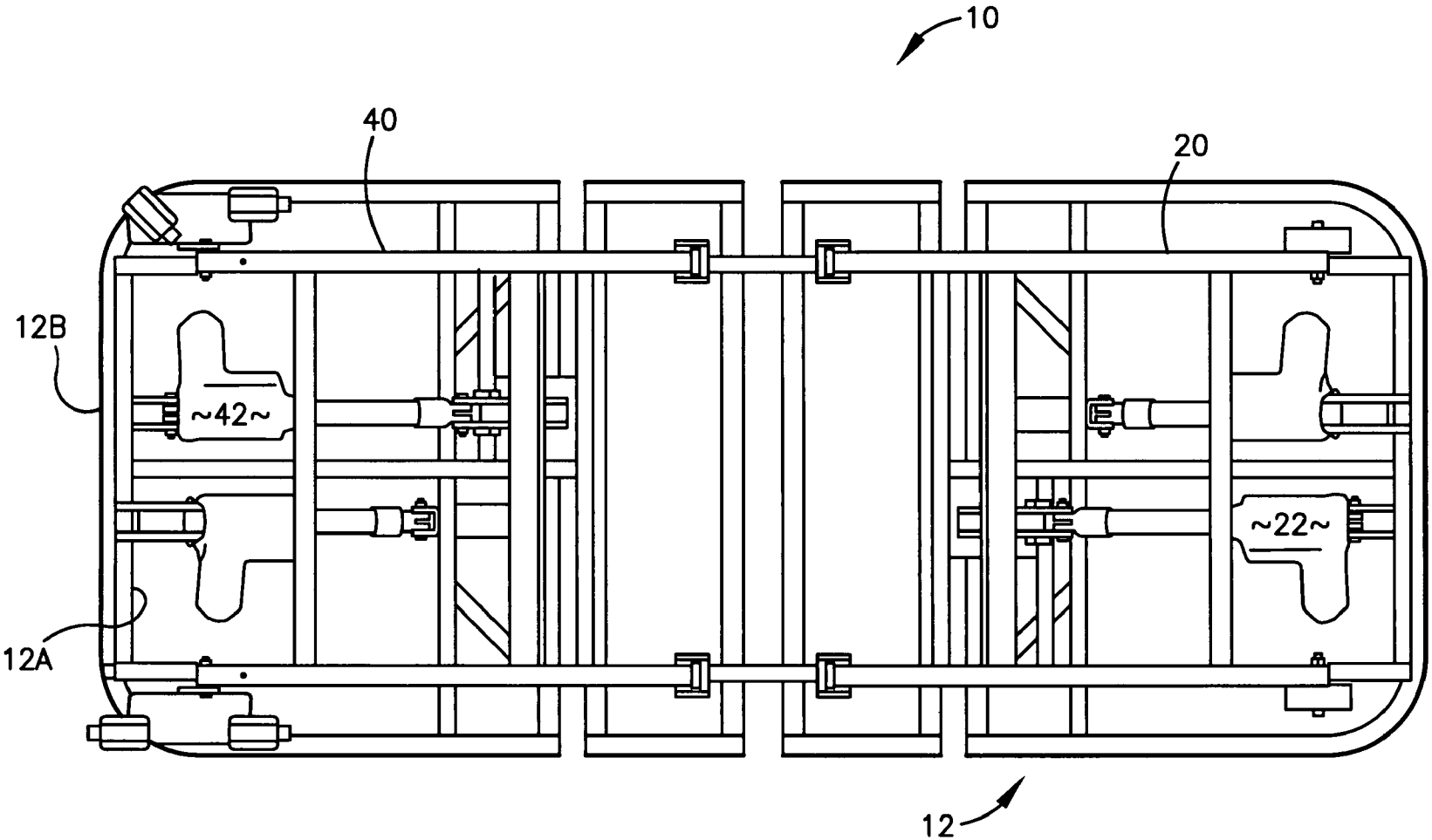
FIG. 3 is a bottom view of the low profile hospital bed in the folded position.
Figure 4:
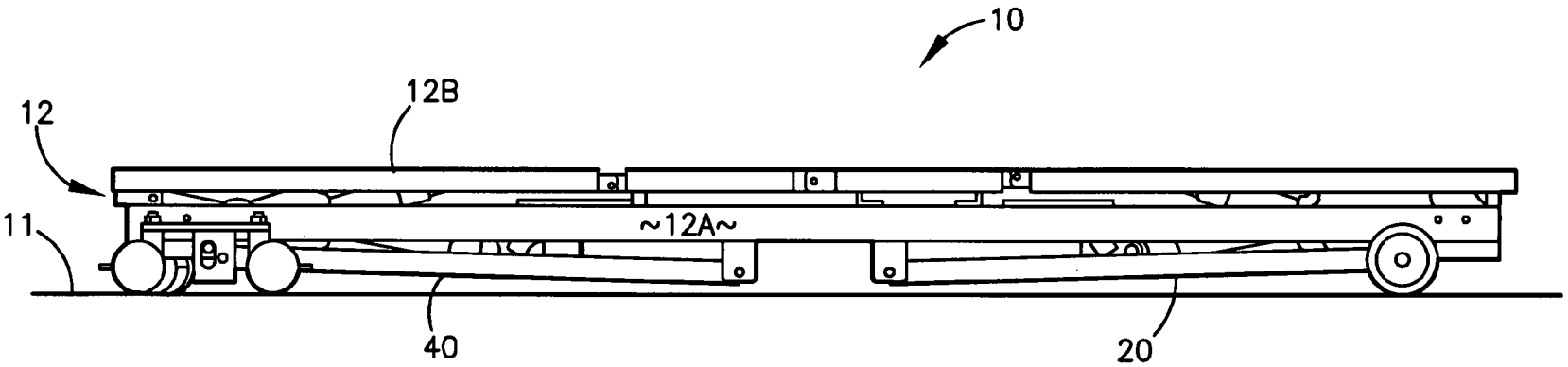
FIG. 4 is a side view of the low profile hospital bed in the folded position.

Referring to the drawings, FIGS. 1–18 show a low profile hospital bed 10 in accordance with an embodiment of the present invention. As can be seen in the referenced figures, hospital bed 10 includes a mattress support frame 12 and opposite wheel frames 20 and 40 pivotably mounted to mattress support frame 12. Wheel frames 20 and 40 carry wheels which are shown to be in contact with floor 11 in FIGS. 4, 5A, 5B, 7, 8, 10A, 11, 14 and 17. Mattress support frame 12 includes a rigid portion 12A and an articulated portion 12B for arranging the relative angles of the various portions of a supported mattress as is well known in the art. A pair of lift actuators 22 and 42 connect between opposite ends of the rigid portion 12A of mattress support frame 12 and leverage members 26 and 46 mounted to wheel frames 20 and 40.

Figure 9:
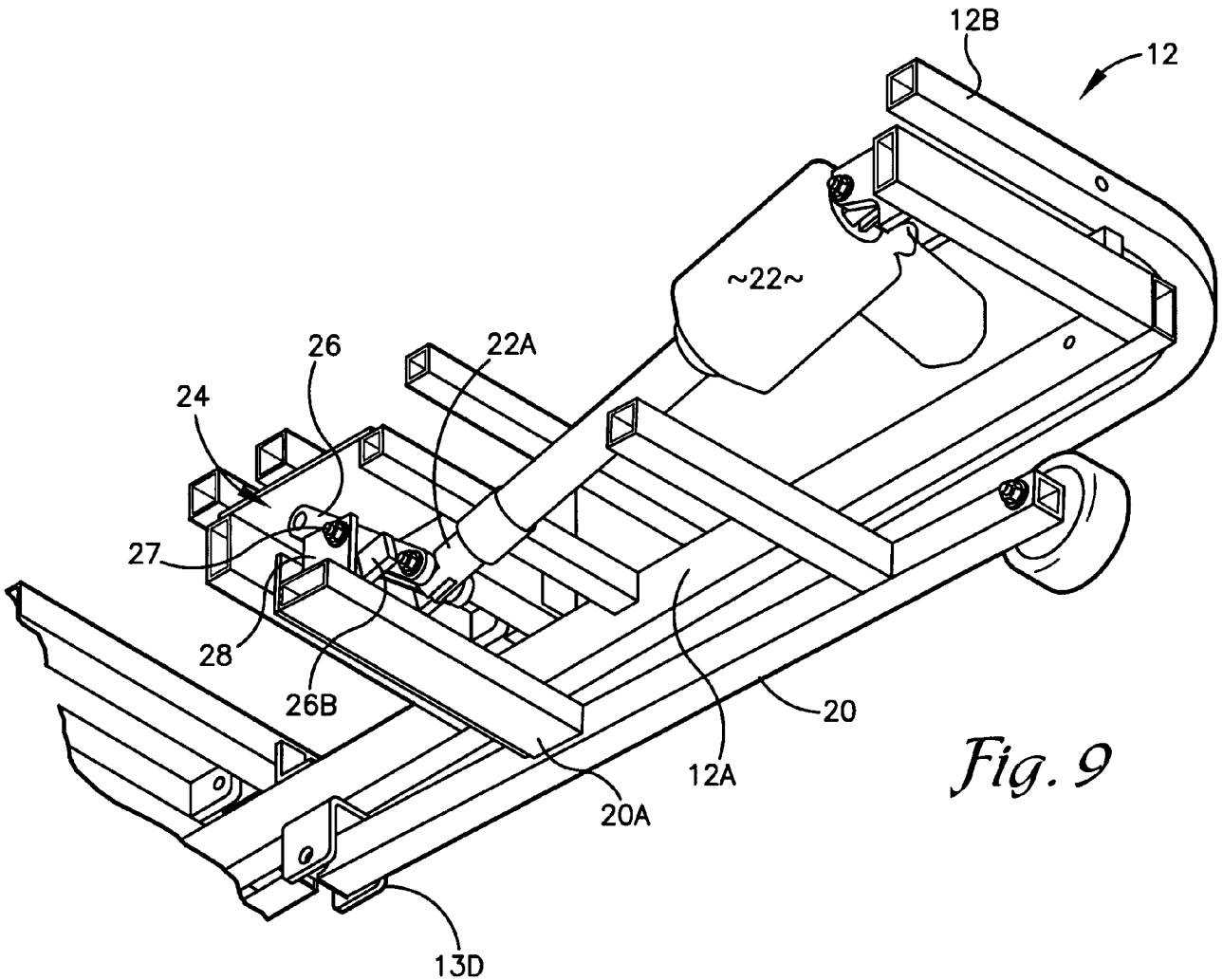
FIG. 9 is a magnified partial bottom perspective view of the hospital bed in a partially unfolded position.
Figure 10:
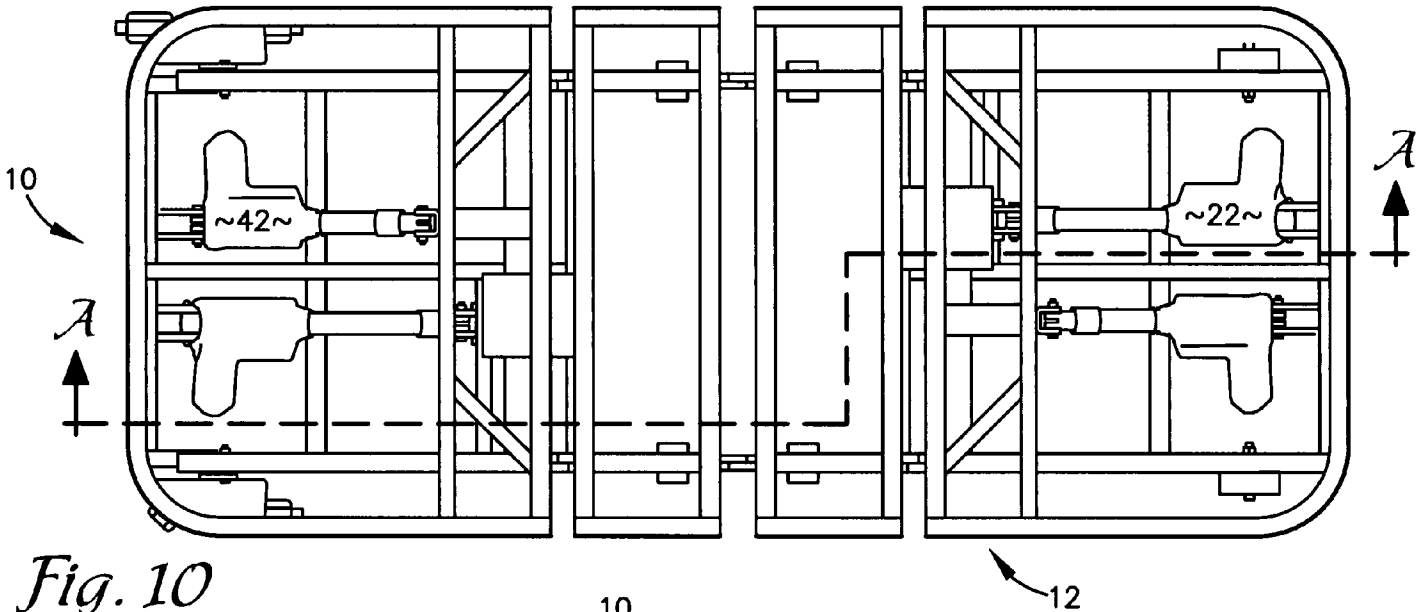
FIG. 10 is a top view of the low profile hospital bed in a partially unfolded.
Figure 10A:
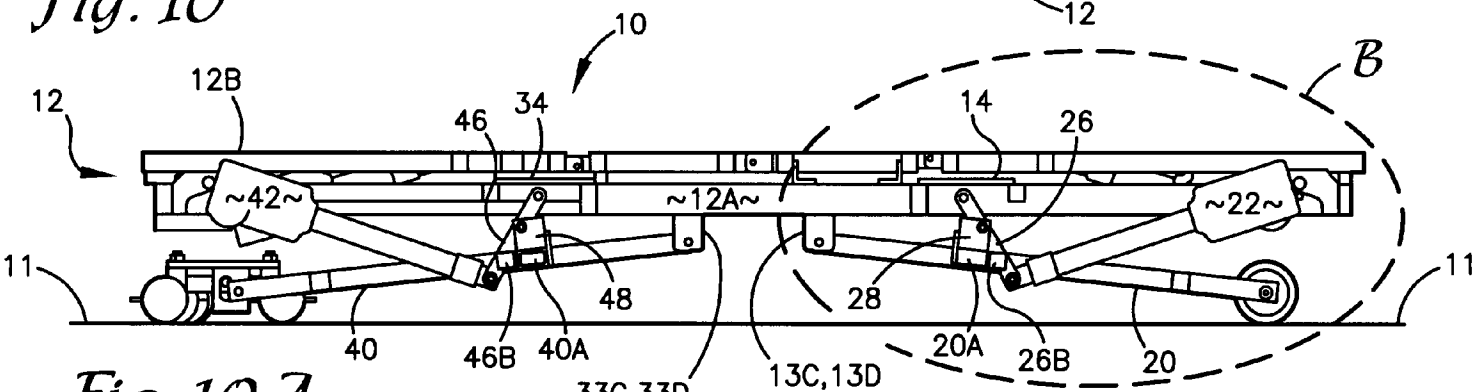
FIG. 10A is a cross sectional side view of the low profile hospital bed taken from plane A—A of FIG. 11 in a partially unfolded position.

Low profile hospital bed 10 employs lift actuators in a mechanism which operates in two stages to pivot each of opposite wheel frames 20 and 40 from a folded position as shown in FIGS. 1–6 to a fully unfolded position as shown in FIGS. 14–18. During the first stage of motion, opposite leverage assemblies 24 and 44 operate to urge wheel frames 20 and 40 away from mattress support frame 12. During this first stage, lift actuators 22 and 42 rotate a pair of relatively short leverage members 26 and 46 which are pivotably mounted to wheel frames 20 and 40 respectively. As leverage members 26 and 46 rotate, they urge wheel frames 20 and 40 away from mattress support frame 12. Thus, during the first stage of motion, each wheel frame 20 and 40 pivots from the first folded position shown in FIGS. 1–6 to an intermediate partially unfolded position shown in FIGS. 7–9 and finally to a partially unfolded position shown in FIGS. 10A–13. At the end of the first stage of motion, wheel frames 20 and 40 are in the partially unfolded position shown in FIGS. 10A–13. As can be seen in FIG. 10A, leverage members 26 and 46 have pivoted to the end of their ranges of motion as stop blocks 26B and 46B fixed respectively to leverage members 26 and 46 engage cross members 20A and 40A of wheel frames 20 and 40. Once these components have translated to the positions shown in FIG. 10A, leverage members 26 and 46 function as simple mechanical links between the lift actuators and the wheel frames and lift actuators 26 and 46 are tilted sufficiently from horizontal such that they can apply enough vertical force to power the complete extension of wheel frames 20 and 40. FIGS. 14–18 show low profile hospital bed 10 or portions of it when it is in a fully extended and fully raised position.

Accordingly, during the first stage of motion described above, lift actuators 22 and 42 cause the rotation of leverage members 26 and 46 relative to wheel frames 20 and 40 in order to pry wheel frames 20 and 40 away from mattress support frame 12. During the second stage of motion, leverage members 26 and 46 are locked from continued rotation such that lift actuators 22 and 42 cause relative motion between mattress support frame 12 and leverage members 26 and 46 and thus further rotation of wheel frames 20 and 40 to which they are attached.

As noted above, the movement of wheel frames 20 and 40 between the folded position to the end of the first stage of motion is accomplished by the rotation of leverage members 26 and 46. Leverage members 26 and 46 are subcomponents of leverage assemblies 24 and 44 which connect between wheel frames 20 and 40 respectively and rigid frame 12A of mattress support frame 12. Because wheel frames leverage assemblies 24 and 44 are preferably symmetrical and identical assemblies, for the sake of clarity and simplicity, it is possible to discuss the detailed structure and function of one wheel frame and its associated leverage assembly. For the purposes of this detailed description, wheel frame 20 and leverage assembly 24 will be described. It should also be understood by the skilled reader that the movements of these generally symmetrical components preferably occur in a substantially symmetrical and synchronized manner so that mattress support frame 12 raises up in a uniform and level fashion.

Figure 5:
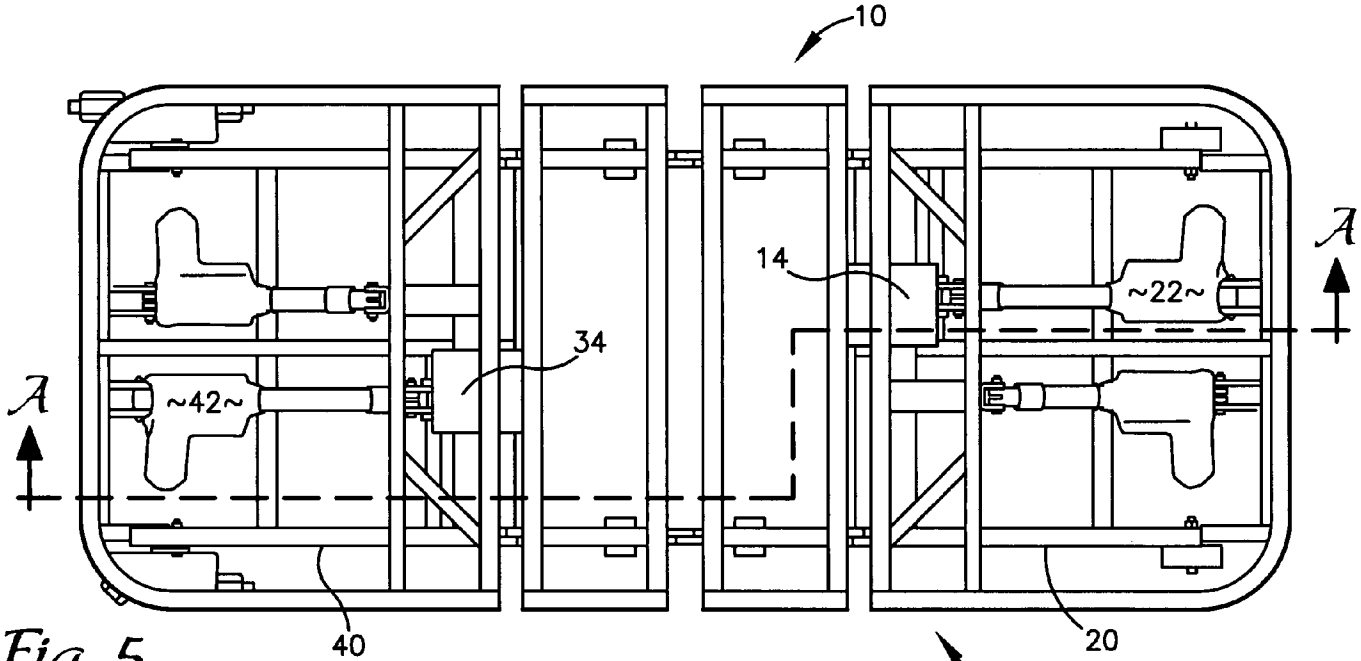
FIG. 5 is a top view of the low profile hospital bed in the folded position.
Figure 5A:
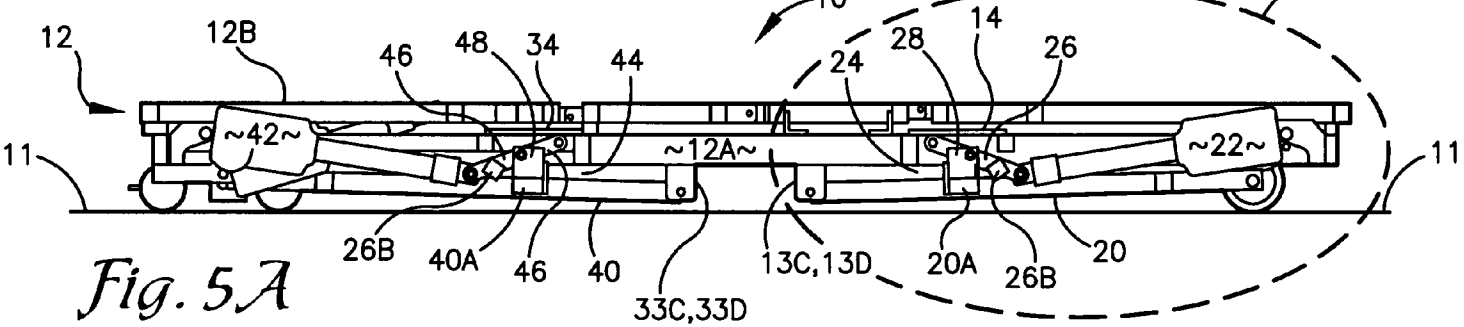
FIG. 5A is a cross sectional side view of the low profile hospital bed in the folded position taken from plane A—A of FIG. 5.
Figure 5B:
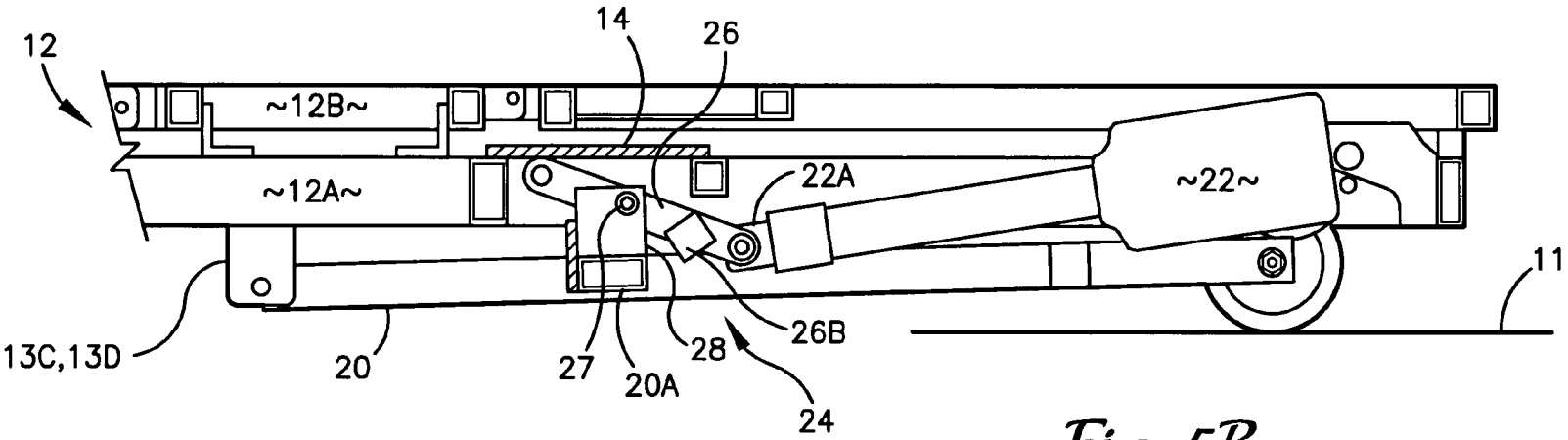
FIG. 5B is a magnified cross sectional side view of the right hand portion the low profile hospital bed taken from portion B of FIG. 5A.

The purpose of leverage assembly 24 is to accomplish the first stage of motion in which leverage member 26 pries wheel frame 20 away from mattress support frame 12 thus lifting mattress support frame 12 from the position shown in FIG. 5A to the position shown in FIG. 10A. Leverage assembly 24 is illustrated in FIG. 5A and FIG. 5B. FIG. 5B is an enlarged view of portion B indicated in FIG. 5A. As is shown in FIG. 5B, leverage assembly 24 includes leverage member 26 which is pivotably mounted at a fulcrum 27 to a clevis bracket 28 fixed to a cross member 20A of wheel frame 20. As can be seen in FIG. 5B, wheel frame 20 is in turn pivotably mounted by opposite devises 13C and 13D to rigid frame 12A of mattress support frame 12. As can be best seen in FIG. 16, leverage member 26 includes a clevis portion at its first end for connecting with the distal end of an actuator rod 22A. As can also be best seen in FIG. 15, leverage member 26 includes a roller 26A mounted within a second clevis portion at its opposite second end. Fixed to the side of leverage member 26 is a pair of stop blocks 26B. The function of stop blocks 26B will be described in greater detail below. A roller track member 14 for engaging roller 26A is mounted to rigid portion 12A of mattress support frame 12.

Figure 6:
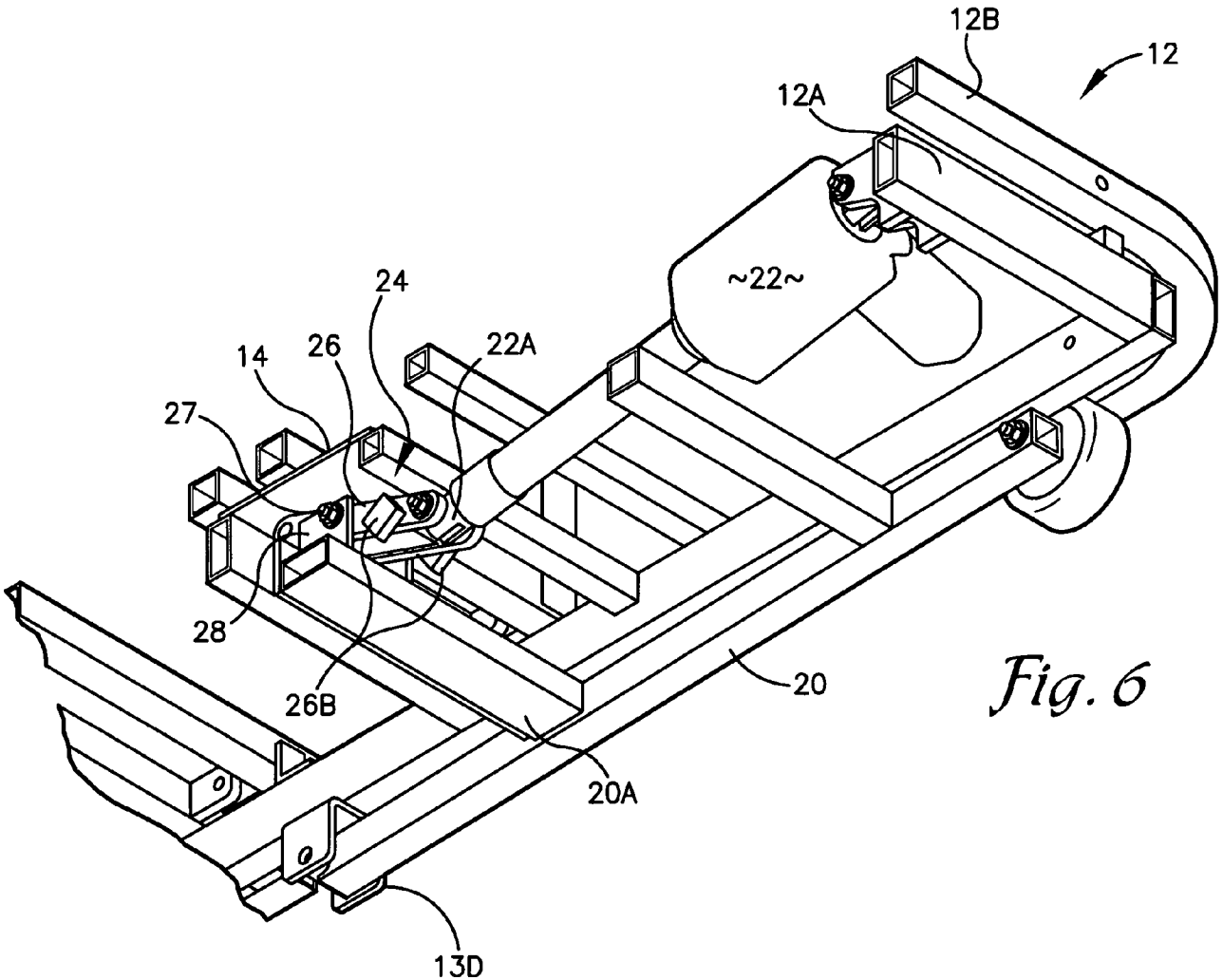
FIG. 6 is a magnified partial bottom perspective view of the right hand portion the low profile hospital bed in the folded position.
Figure 7:
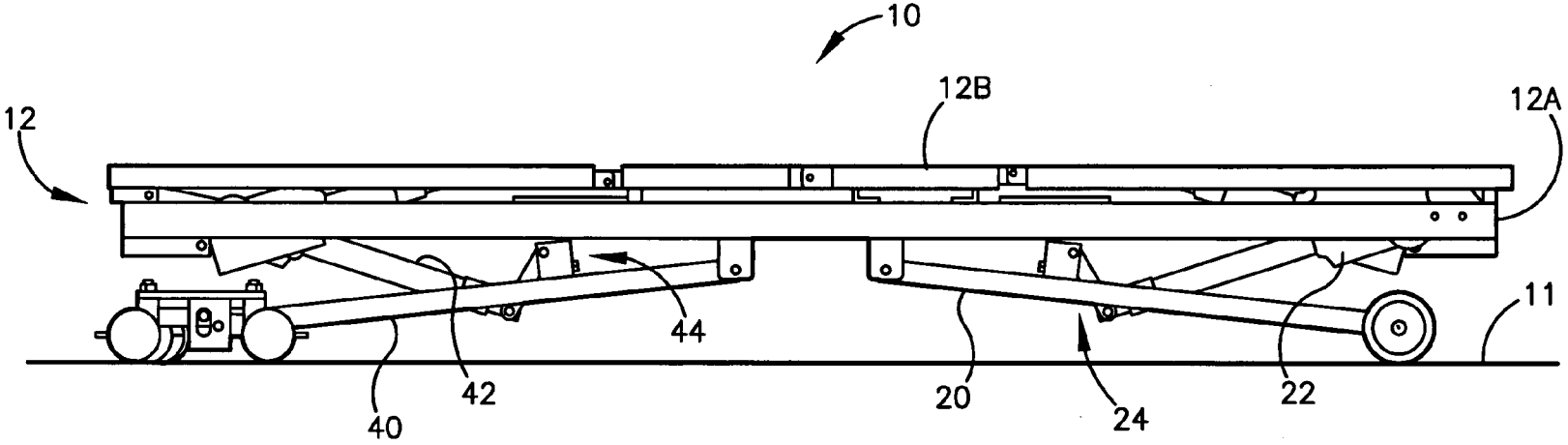
FIG. 7 is a side view of the right side of the low profile hospital bed in a partially unfolded position.
Figure 8:
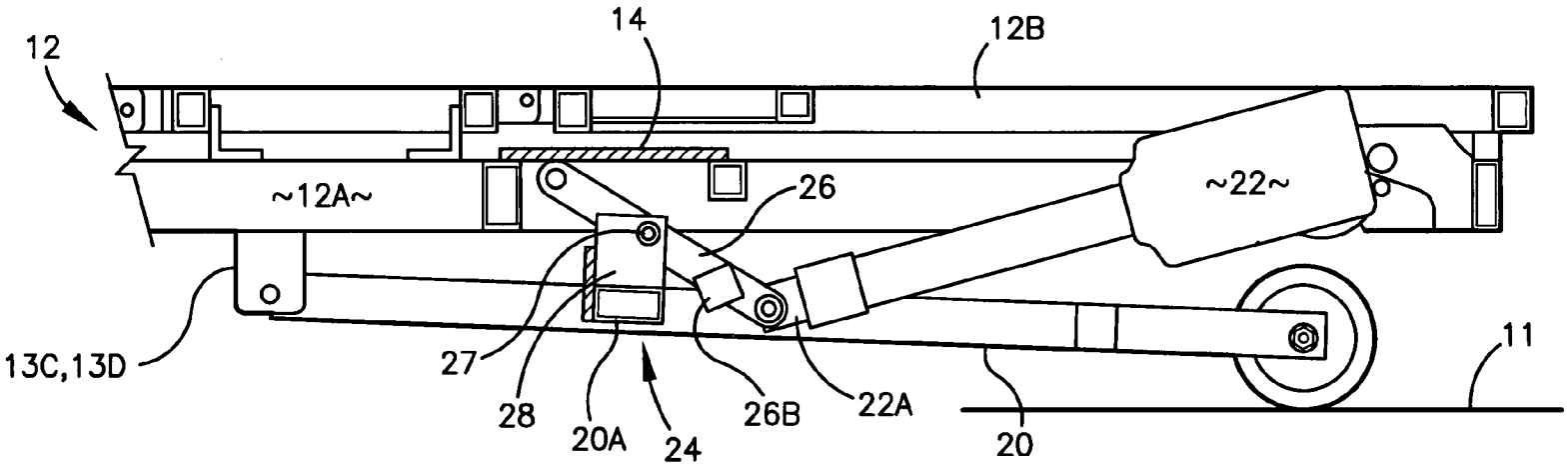
FIG. 8 is a magnified partial cross sectioned side view of the low profile hospital bed in a partially unfolded position.
Figure 11:
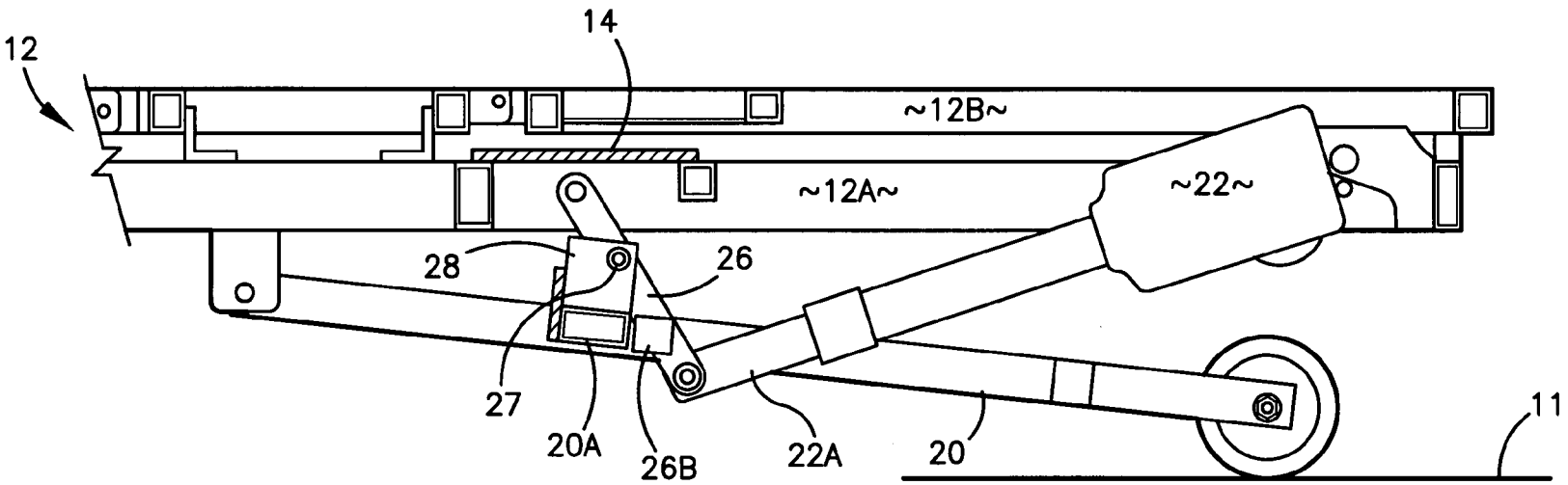
FIG. 11 is a magnified cross sectional side view of the right hand portion the low profile hospital bed in a partially unfolded position taken from portion B of FIG. 10A.
Figure 12:
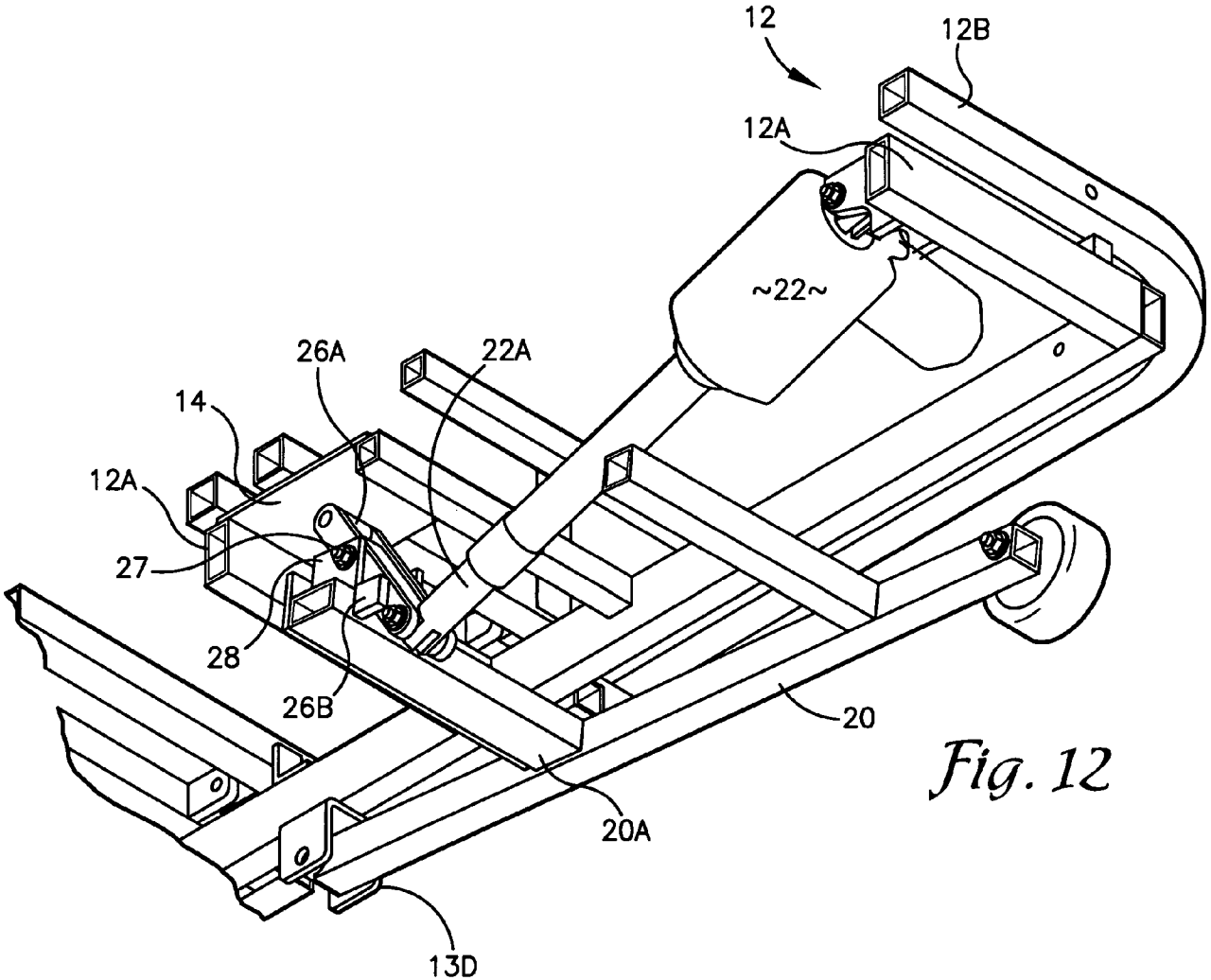
FIG. 12 is a magnified partial bottom perspective view of the right hand portion the low profile hospital bed in a partially unfolded position.
Figure 13:
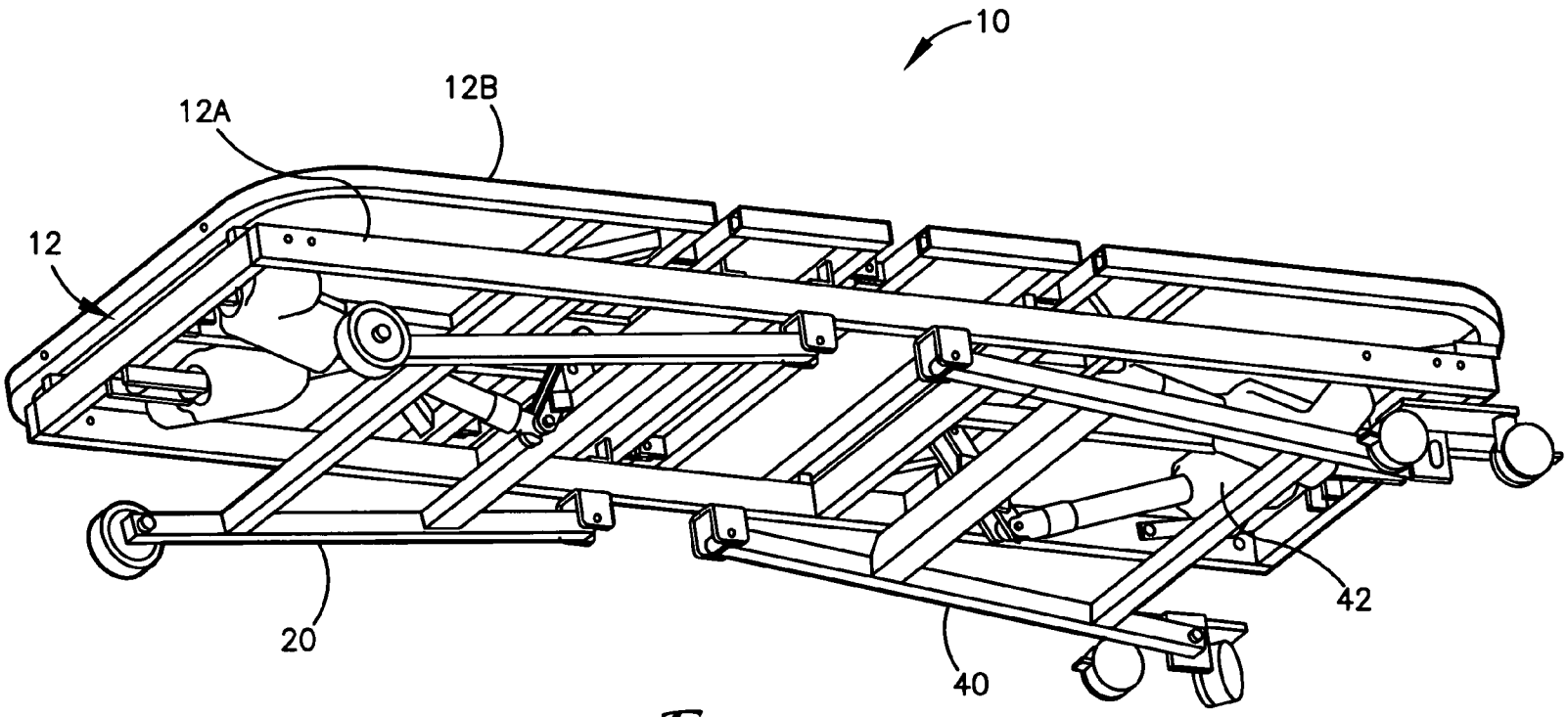
FIG. 13 is a bottom perspective full view the low profile hospital bed in a partially unfolded position.
Figure 14:
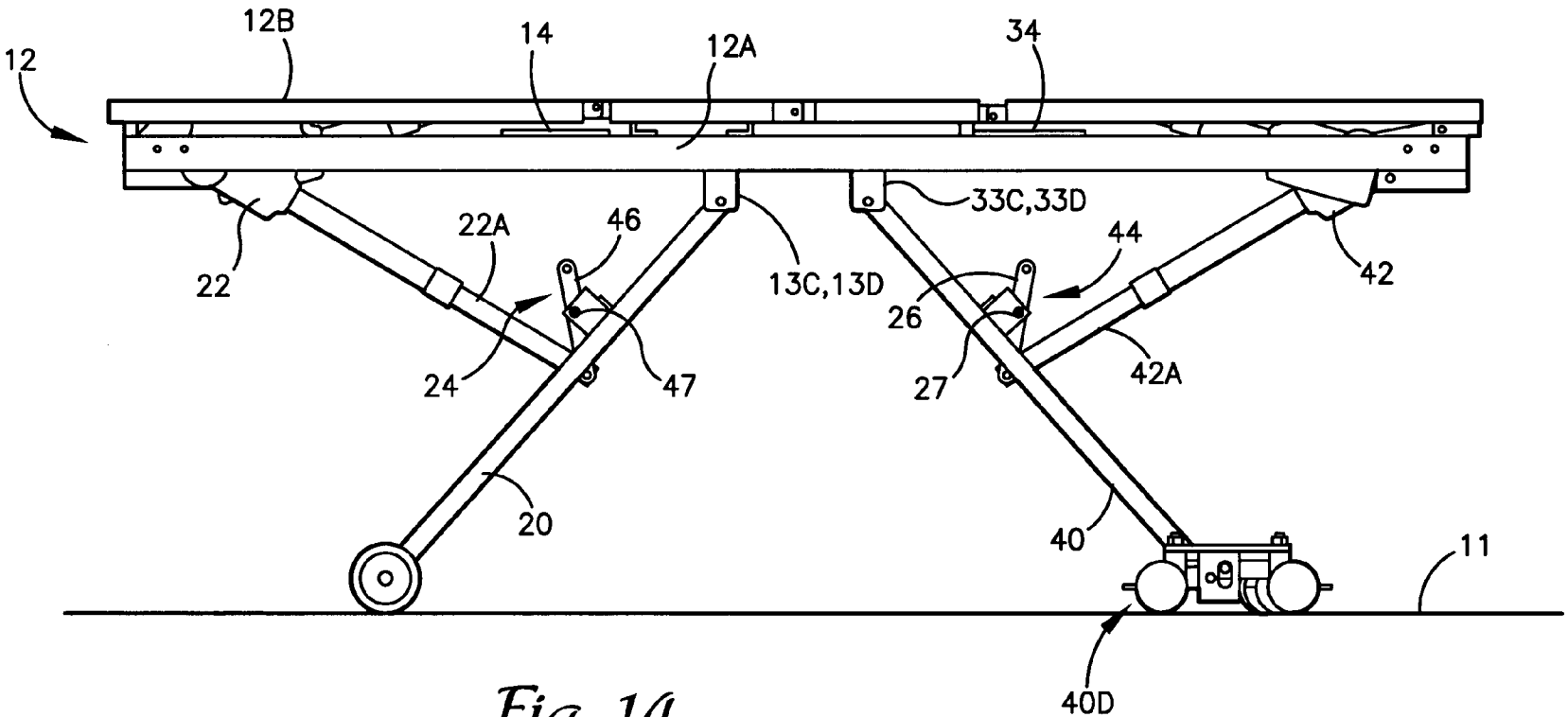
FIG. 14 is a side view of the low profile hospital bed in a fully unfolded position.
Figure 15:
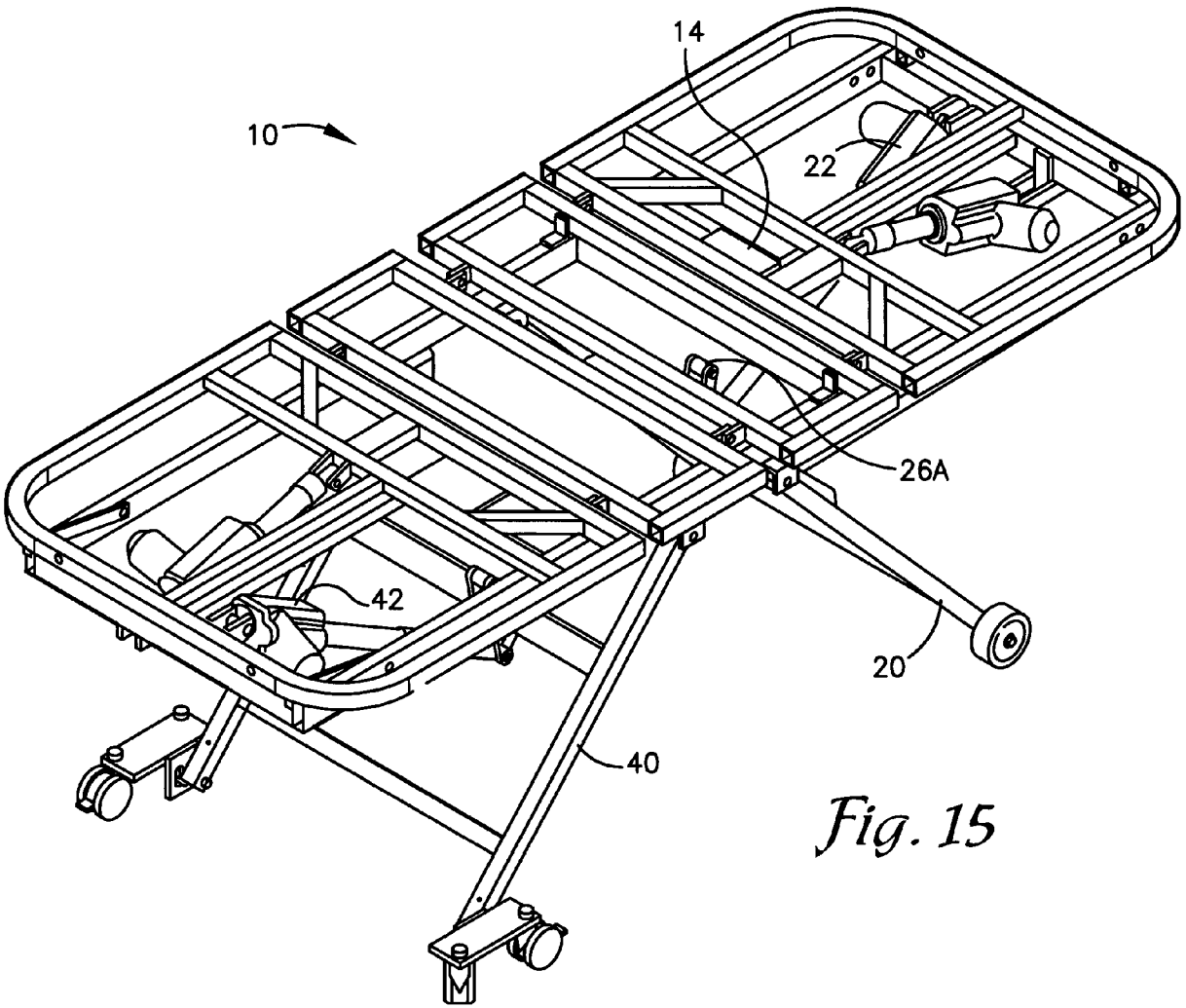
FIG. 15 is top perspective view of the low profile hospital bed in the fully unfolded position.

The motion of the first stage may be understood by comparing FIGS. 5B, 8 and 11. In FIGS. 5A–6, leverage assembly 24 is positioned at the beginning of the first stage. In FIGS. 5A–6, leverage member 26 is oriented such that roller 26A is in contact with roller track member 14 but may be envisioned as not applying significant force to roller track member 14. In FIGS. 5A–6, actuator rod 22A is completely retracted and wheel frame 20 is in a folded position thus allowing a very low profile for low profile bed 10. FIGS. 7–9 show leverage assembly 24 after lift actuator 22 has rotated leverage member 26 clockwise approximately 20° with respect to clevis bracket 28. When leverage assembly 24 is in this position, actuator rod 22A of lift actuator 22 is slightly extended, roller 26A has moved along roller track member 14 and is applying a significant force upon roller track member 14, stop block 26B is approaching its contact position with cross member 20A and most importantly, wheel frame 20 has been pried away from its folded position to a slightly unfolded position. During this stage of motion, the prying action of leverage member 26 against roller track member 14 amplifies the otherwise insufficient vertical force component of the nearly horizontal lift actuator 22 to provide a vertical force sufficient to pivot wheel frames 20 away from mattress support frame 12 thus lifting mattress support frame 20.

FIGS. 10–13 show low profile bed 10 and more particularly leverage assembly 24 at the end of the first stage of motion and at the beginning of the second stage of motion. In FIGS. 10–13, stop blocks 26B are in contact with cross member 20A of wheel frame 20. In FIGS. 10–13, leverage member 26 can be envisioned as having rotated from a first position shown in FIGS. 5B to a second position shown in FIG. 11. Because stop block 26B interferes with cross member 20A of wheel frame 20 when leverage member reaches the second position shown in FIG. 11, leverage member 26 can not rotate past the second position shown in FIG. 11. When leverage member 26 is in the second position shown in FIG. 11, the force applied by roller 26A to roller track member 14 shifts to stop blocks 26B as leverage member 26 is locked from further rotation away from the first position relative to leg assembly 20. Note that leverage member 26 is locked from further rotation before it reaches a top dead center position in which leverage member 26 would be generally normal to wheel frame 20 or generally normal to roller track member 14. This allows for continuous and smooth motion as wheel frame 20 is unfolding and when wheel frame 20 is folding to return to the position shown in FIGS. 1–6. After leverage member 26 is locked by contact between stop block 26B and cross member 20A, lift actuator 22 continues extending as wheel frame 20, in the second stage movement, extends into the fully unfolded position shown in FIGS. 14–18.

Figure 16:
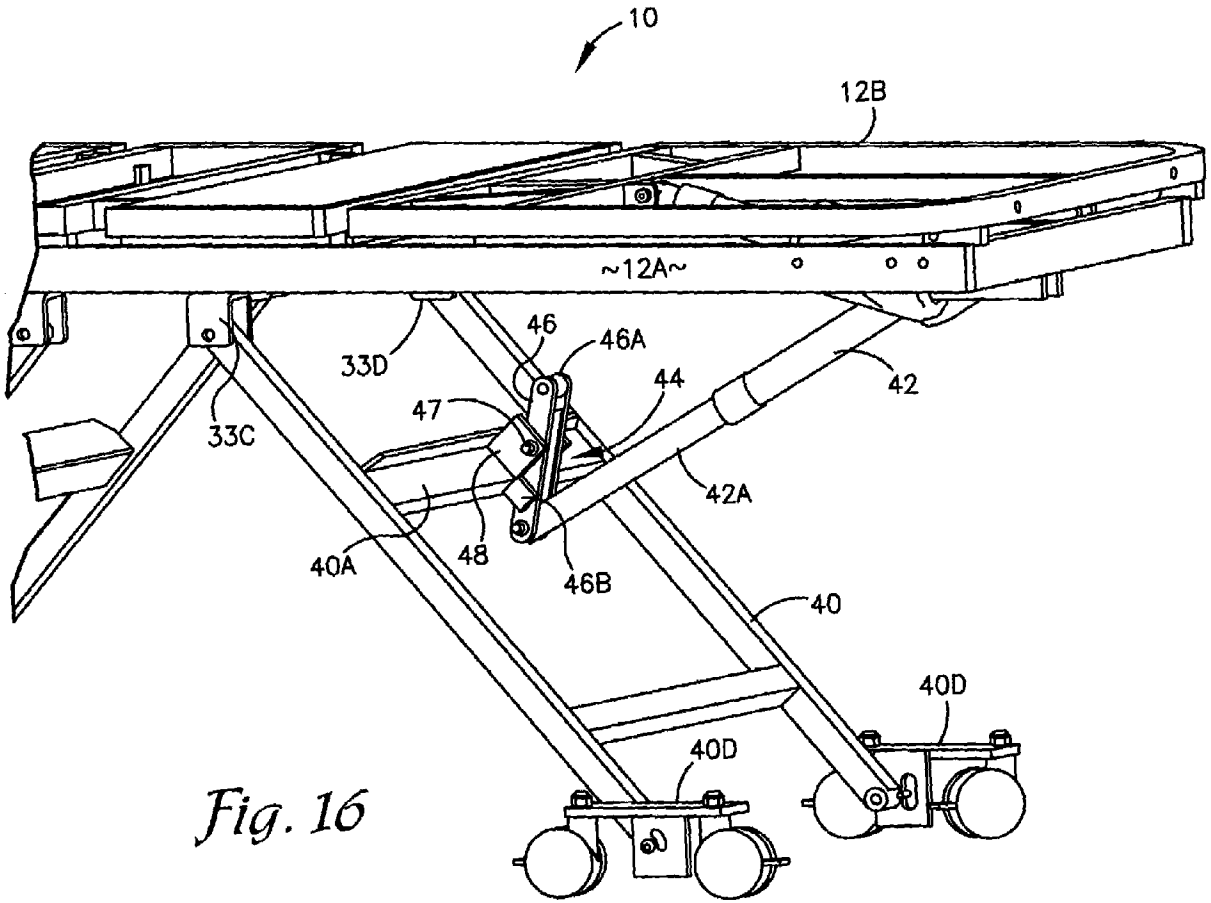
FIG. 16 is a partial perspective view of the low profile hospital bed in the fully unfolded position.
Figure 17:
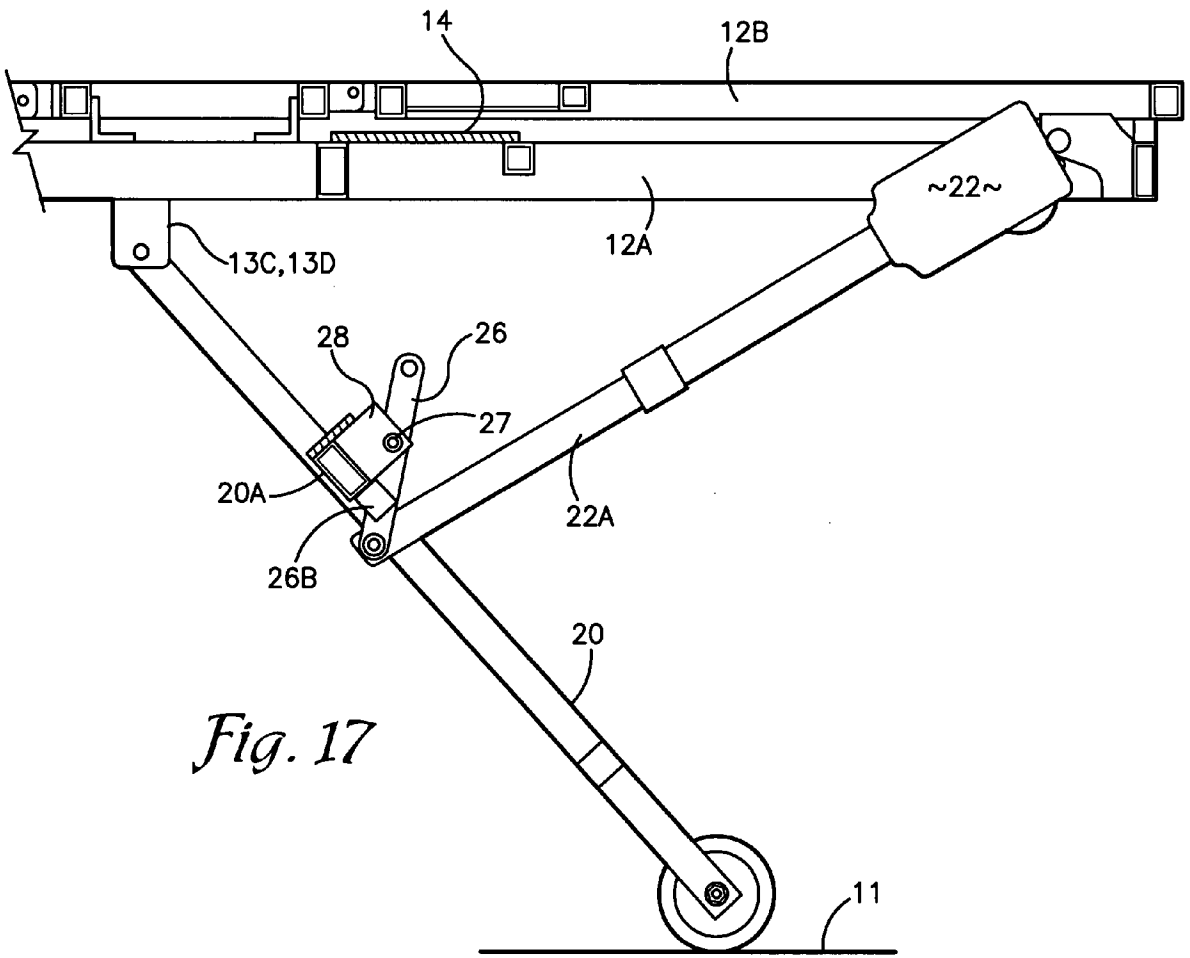
FIG. 17 is a partial side view of the low profile hospital bed in the fully unfolded position.

FIG. 16 provides a perspective view of the opposite end of low profile hospital bed 10. As can be seen in FIG. 16, the components described above are mirrored by generally opposite, symmetrical components and are given reference numbers which are twenty greater than those given to the components described above. Accordingly, lift actuator 42 and leverage assembly 44 associate between rigid frame portion 12A and wheel frame 40. Leverage assembly 44 includes a leverage member 46 having a roller 46A and a stop block 46B. Leverage member 46 is pivotably mounted to a cross member 40A by a clevis bracket 48. Wheel frame 40 is pivotably mounted to rigid portion 12A of mattress support frame 12 by a pair of clevis brackets 33C and 33D.

Accordingly, low profile hospital bed 10 described above solves the above stated problem by providing an extremely low profile bed which can raise itself and a patient to an elevation which is easily accessible for doctors and nurses attending the patient. When in the lowered position, low profile hospital bed 10 provides a safe support for a patient who is susceptible to rolling or falling out of bed.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A low profile bed comprising:

(a) a mattress support frame, (b) at least one wheel frame pivotably mounted to said mattress support frame for movement between a folded position and an unfolded position, (c) a leverage member pivotably mounted to said at least one wheel frame, and, (d) a lift actuator connecting between said mattress support frame and said leverage member, said lift actuator for extending and contracting movement between a retracted position and an extended position, said lift actuator and said leverage member arranged such that initial extension of said lift actuator causes said leverage member to push against said mattress support frame and urge said at least one wheel frame away from said mattress support frame until said wheel frame reaches a partially unfolded position and such that subsequent extension of said lift actuator powers further unfolding of said at least one wheel frame from said partially unfolded position to a fully unfolded position.

2. The low profile hospital bed of claim 1 wherein, said leverage member is pivotably mounted to said at least one wheel frame about a fulcrum disposed between opposite first and second ends of said leverage member and said lift actuator connects between said mattress support frame and said second end of said leverage member, said first end of said leverage member for pushing against said mattress support frame upon said initial extension of said lift actuator.

3. The low profile hospital bed of claim 1 wherein, said leverage member is pivotably mounted to said at least one wheel frame about a fulcrum disposed between opposite first and second ends of said leverage member and said lift actuator connects between said mattress support frame and said second end of said leverage member, said first end of said leverage member including a roller and said mattress support frame including a roller track member for rolling contact with said roller, the roller for pushing against said roller track member of said mattress support frame upon said initial extension of said lift actuator.

4. The low profile hospital bed of claim 1 wherein, said at least one wheel frame includes two wheel frames pivotably mounted to said mattress support frame and wherein a lift actuator connects between said mattress support frame and a leverage member mounted to each of said wheel frames.

5. The low profile hospital bed of claim 1 wherein, said at least one wheel frame includes two wheel frames pivotably mounted to said mattress support frame and wherein a lift actuator connects between said mattress support frame and a leverage member mounted to each of said wheel frames, and, each said leverage member is pivotably mounted to said at least one wheel frame about a fulcrum disposed between opposite first and second ends of said leverage member and each said lift actuator connects between said mattress support frame and said second end of one of said leverage members, said first end of each of said leverage members for pushing against said mattress support frame upon said initial extension of each of said lift actuators.

6. The low profile hospital bed of claim 1 wherein, said at least one wheel frame includes two wheel frames pivotably mounted to said mattress support frame and wherein a lift actuator connects between said mattress support frame and a leverage member mounted to each of said wheel frames, and each of said leverage members is pivotably mounted to each of said wheel frames about a fulcrum disposed between opposite first and second ends of each of said leverage members and each of said lift actuators connects between said mattress support frame and said second end of one of said leverage members, said first end of each of said leverage members including a roller and said mattress support frame including roller track members for rolling contact with said rollers, the rollers for pushing against said roller track members of said mattress support frame upon initial extension of said lift actuators.

7. A low profile hospital bed comprising, (a) a mattress support frame, (b) wheel frames pivotably mounted to said mattress support frame for generally simultaneous pivoting movement between a folded position in which said mattress support frame is at a minimum distance above the floor and a completely unfolded position in which said mattress support frame is at a maximum distance above the floor, (b) leverage members pivotably mounted to each of said wheel frames, each leverage member having a first end and a second end and pivotably mounted to each of said wheel frames at a fulcrum which is between said first and second ends, (c) a lift actuator connecting between said mattress support frame and said first end of each said leverage member, each said lift actuator for extending and contracting movement between a retracted position and an extended position, each of said lift actuators and each of said leverage members arranged such that initial extension of said lift actuator causes said second ends of said leverage members to push against said mattress support frame and urge said wheel frames away from said mattress support frame until said wheel frames reach a partially unfolded position and such that said subsequent extension of said lift actuators powers further unfolding of said wheel frames from said partially unfolded position to a fully unfolded position.

8. The low profile hospital bed of claim 7, wherein, each first end of each said leverage member includes a roller and said mattress support frame includes roller track members for rolling contact with said rollers, the rollers for pushing against said roller track members of said mattress support frame upon initial extension of said lift actuators.

9. The low profile hospital bed of claim 7, wherein, each leverage member and each wheel frame are arranged such that each leverage member is free to rotate between a first position to a second position as each wheel frame moves between said folded position and a partially unfolded position and such that each leverage member is prevented from further rotation away from said first position past said second position when each wheel frame moves between said partially unfolded position and said fully unfolded position.

10. The low profile hospital bed of claim 7, wherein, each leverage member includes a stop block which interferes with said wheel frames such that each leverage member may rotate between a first position and a second position as said wheel frames moves between said folded position and a partially unfolded position and such that each stop block interferes with said wheel assembly thus preventing said leverage member from further rotation away from said first position past said second position as said wheel frame moves between said partially unfolded position and said fully unfolded position.

11. A method for unfolding a low profile hospital bed having a mattress support frame from a folded position wherein said mattress support frame is supported at a desired minimum distance above a floor to an unfolded position wherein said mattress support frame is supported at a desired maximum distance above said floor, the method comprising the following steps, (a) providing wheel frames pivotably attached to said mattress support frame, (b) providing leverage members pivotably attached to said wheel frames about a fulcrum which is between opposite first and second ends of each leverage member for rotating movement between a first position and a second position such that said leverage members push against said mattress support frame and urge said wheel frames away from said mattress support frame as said leverage assemblies rotate from said first position to said second position, (c) rotating said leverage members from said first position to said second position to cause partial unfolding of said wheel frames to a partially unfolded position, (d) rotating said wheel frames relative to said mattress support assembly to cause further unfolding of said wheel frames from said partially unfolded position to said unfolded position in which said mattress support frame is supported at a desired maximum distance above the floor.

12. The method of claim 11 including preventing said leverage members from continued rotation past said second position in a direction away from said first position.

13. A method for unfolding a low profile hospital bed having a mattress support frame from a folded position wherein said mattress support frame is supported at a desired minimum distance above a floor to an unfolded position wherein said mattress support frame is supported at a desired maximum distance above said floor, the method comprising the following steps, (a) providing wheel frames pivotably attached to said mattress support frame, (b) providing leverage members pivotably attached to said wheel frames about a fulcrum which is between opposite first and second ends of each leverage member for rotating movement between a first position and a second position, said leverage members arranged to push against said mattress support frame and urge said wheel frames away from said mattress support frame as said leverage assemblies rotate from said first position to said second position, (c) rotating said leverage members from said first position and said second position in order to urge said wheel frames into a partially unfolded position, (d) preventing said leverage members from continued rotation relative to said wheel frames past said second position in a direction away from said first position, and, (e) causing relative motion between said leverage members and said mattress support frame in order to accomplish continued rotation of said wheel frames relative to said mattress support frame until said wheel frames reach said unfolded position in which said mattress support frame is supported at a desired maximum distance above the floor.

14. The method of claim 13 including the additional steps of:

(a) causing reverse relative motion of said leverage members relative to said mattress support frame so that said wheel frames rotate back to said partially unfolded position, and, (b) causing reverse rotation of said leverage members from said second position to said first position to allow folding of said wheel frames to said folded position in which said mattress support frame is supported at a desired minimum distance above the floor.

* * * * *

UNITED STATES PATENT AND TRADEMARK OFFICE

CERTIFICATE OF CORRECTION

PATENT NO. : 7,013,510 B1
DATED : March 21, 2006
INVENTOR(S) : Michael Karl Johnson It is certified that error appears in the above-identified patent and that said Letters Patent is hereby corrected as shown below:

Column 7,
Line 24, delete “moves” and insert -- move --.

Signed and Sealed this

Twenty-third Day of May, 2006

JON W. DUDAS
*Director of the United States Patent and Trademark Office*